US006660982B2

(12) United States Patent
Thorneywork

(10) Patent No.: US 6,660,982 B2
(45) Date of Patent: Dec. 9, 2003

(54) PROGRAMMABLE COOKING SYSTEMS

(75) Inventor: Nigel Thorneywork, Guildford (GB)

(73) Assignee: Merrychef Limited, Hampshire (GB)

( * ) Notice: Subject to any disclaimer, the term of this patent is extended or adjusted under 35 U.S.C. 154(b) by 387 days.

(21) Appl. No.: 09/797,457

(22) Filed: Mar. 1, 2001

(65) Prior Publication Data

US 2002/0030051 A1 Mar. 14, 2002

(30) Foreign Application Priority Data

Sep. 13, 2000 (GB) ..... 0022378

(51) Int. Cl.[7] ..... H05B 6/68

(52) U.S. Cl. ..... 219/702; 219/714; 219/490; 99/325

(58) Field of Search ..... 219/702, 714, 219/720, 490, 506, 480; 99/325, 451; 700/207, 211

(56) References Cited

U.S. PATENT DOCUMENTS

| | | | | |
|---|---|---|---|---|
| 3,569,656 A | * | 3/1971 | White et al. | 219/714 |
| 4,345,132 A | | 8/1982 | Takase et al. | 219/10.55 B |
| 4,390,965 A | * | 6/1983 | Albert | 219/702 |
| 4,841,125 A | | 6/1989 | Edamura | 219/508 |
| 5,245,329 A | * | 9/1993 | Gokcebay | 340/825.31 |
| 5,353,434 A | * | 10/1994 | Katayama | 395/550 |
| 6,080,972 A | * | 6/2000 | May | 219/494 |
| 6,137,095 A | * | 10/2000 | Kashimoto et al. | 219/702 |

FOREIGN PATENT DOCUMENTS

| | | | |
|---|---|---|---|
| DE | 94 00 564 | * | 4/1994 |
| DE | 43 17 624 | * | 6/1994 |
| DE | 43 45 031 | * | 7/1995 |
| GB | 2328884 A | | 6/1998 |

OTHER PUBLICATIONS

UK Search Report.

* cited by examiner

*Primary Examiner*—Philip H. Leung
(74) *Attorney, Agent, or Firm*—Ohlandt, Greeley, Ruggiero & Perle, L.L.P.

(57) ABSTRACT

A programmable cooking system comprising a plurality of programmable cooking devices and at least one data key. Each data key is provided with a data memory for storing program data corresponding to sequences of cooking operations, and the data memory is divided into a plurality of parts each corresponding to a respective one of said cooking devices. Each programmable cooking device includes a programmable control for controlling the cooking device to carry out sequences of cooking operations each of which may use a different cooking power and cooking time duration. Each programmable cooking device further includes a key aperture adapted to receive one of the data keys and a data reader arranged to read from the data key program data from that part of the data memory corresponding to the cooking device, and pass the program data to the programmable control of the cooking device thus making the appropriate sequences of cooking operations available to the cooking device.

23 Claims, 6 Drawing Sheets

| | | | Time | Temperature | Power | | |
|---|---|---|---|---|---|---|---|
| B1 | P1 | S1 | xxxx | xxxx | xxxx | TYPE A OVEN | Microwave Combi |
| | | S2 | | | | | |
| | | S3 | | | | | |
| | P2 | S1 | | | | | |
| | | S2 | | | | | |
| | | S3 | | | | | |
| | P3 | S1 | | | | | |
| | | S2 | | | | | |
| | | S3 | | | | | |
| B2 | P1 | S1 | xxxx | | xxxx | TYPE B OVEN | Microwave |
| | | S2 | | | | | |
| | | S3 | | | | | |
| | P2 | S1 | | | | | |
| | | S2 | | | | | |
| | | S3 | | | | | |
| | P3 | S1 | | | | | |
| | | S2 | | | | | |
| | | S3 | | | | | |
| B3 | P1 | S1 | xxxx | xxxx | | TYPE C OVEN | Convection |
| | P2 | | | | | | |
| | P3 | | | | | | |
| B4 | P1 | | | | | TYPE D OVEN | Steam Combi |
| | P2 | | | | | | |
| | P3 | | | | | | |
| B5 | P1 | | | | | | Hob |
| | P2 | | | | | | |
| | P3 | | | | | | |

FIG.4

MC = Merrychef Ltd.

PROGRAMMABLE COOKING SYSTEMS

This application claims priority to British Application No. 0022378.4, filed Sep. 13, 2000.

BACKGROUND OF THE INVENTION

The invention relates to programmable cooking systems and methods of operating programmable cooking systems. The invention is particularly, although not exclusively, concerned with programmable cooking systems comprising one or more microwave or combination ovens.

In the catering industry there is increasingly a need to be able to deliver a given range of meals from a menu at maximum speed and efficiency. In order to achieve this, it is common to use pre-programmed cooking devices, such as microwave ovens, which are loaded with program data representing an optimised cooking sequence for each item on the menu.

For example, a combination oven (being an oven which can make use of a combination of microwave and conventional heating) may contain a cooking sequence for a given item on the menu which comprises three stages, namely a defrosting stage, a microwave cooking stage, and finally a browning stage using conventional heating.

It will be appreciated that the cooking sequences must be carefully tailored to the particular oven being used, and the item to be cooked must match certain criteria (relating to the size and positioning of the food etc.) which are specified in advance. In order to avoid the need for the chef to manually program each cooking sequence into each oven, ovens are known which allow the chef to select each cooking sequence at the push of a button, or by entering a number corresponding to that cooking sequence.

For example, an oven is made by Merrychef Ltd and sold under the name "Mealstream" which allows 10 different cooking sequences to be selected by simply pressing one of 10 different numbered buttons corresponding to the desired cooking sequence.

However, a problem can arise when it is required to change a menu for a different menu, as may happen on different days during the week, or at different times during the same day. In addition it may be necessary to update menus to reflect items added or deleted from a given menu.

In this regard it should be appreciated that the cooking sequences are usually determined at a different site (referred to herein as a data site) from the site at which the ovens are used (referred to herein as the cooking site), and there may be a number of cooking sites serviced by a single data site.

In order to address this problem, it is known to update the program data for an oven using a modem connection to the oven, which allows data to be delivered from the data site to the cooking site. It is also known from U.S. Pat. No. 4,841,125 to use separate ROM modules which can be inserted into the oven in order to update the program data. Such ROM modules could for example be despatched by post from the data site to the cooking site.

However, further problems can arise if the cooking site is relatively large and comprises an array of different cooking devices, such as microwave ovens, combination ovens, conventional ovens, steam combination ovens (using a combination of steam and conventional heating), and hobs. All of these cooking devices can be programmable, and all can be provided with program data representing a number of different cooking sequences corresponding to different items on a menu.

Modem solutions can be costly because it is necessary to supply each cooking device with a modem. Furthermore, because the data is sent from a remote site, the chef may lose some control over exactly which updates are made and exactly when these updates are made.

If ROM modules are used, the system can become complex to operate because it is necessary to supply a different module for each cooking device, and it is necessary for the chef to insert different modules into each cooking device each time it is required to change or update menus. As a result of this complexity errors can arise.

SUMMARY OF THE INVENTION

The invention seeks to overcome at least some of the disadvantages of the prior art.

According to the invention there is provided a programmable cooking system, and a method of operating such a system, as set out in the accompanying claims.

It will be appreciated that because a single data key can be used with a number of different programmable cooking devices, the complexity involved in operating the system is reduced. The system is thus easier for the chef to use, and the likelihood of mistakes being made during the operation of the system is reduced.

BRIEF DESCRIPTION OF THE DRAWINGS

Embodiments of the invention will now be described, by way of example only, with reference to the accompanying drawings, in which:

FIG. 4 shows the arrangement of blocks of memory on the data key;

DETAILED DESCRIPTION

Figure 1:
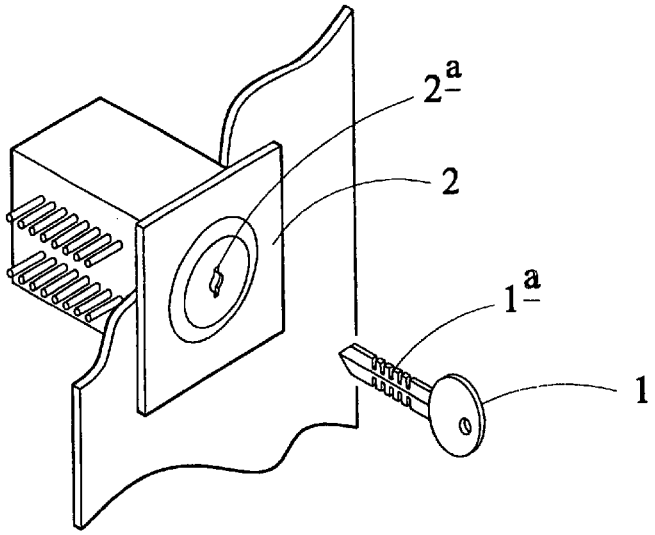
FIG. 1 shows a data key and key aperture for use with the embodiments described.

FIG. 1 shows a data key 1 (for example Serial Memory Token LCK 16000 manufactured by Datakey, Inc. of 407 West Travellers Trail, Burnsville, Minn. 55337, USA) and a data key reader 2. The reader 2 is provided with a key aperture 2*a* adapted to receive the key 1 in order to allow data to be passed to and from the key 1. The key 1 is provided with $E^2$PROM (electrically erasable programmable ROM) for storing data, and with a number of electrical contacts 1*a* for communicating with the reader 2.

Figure 2:
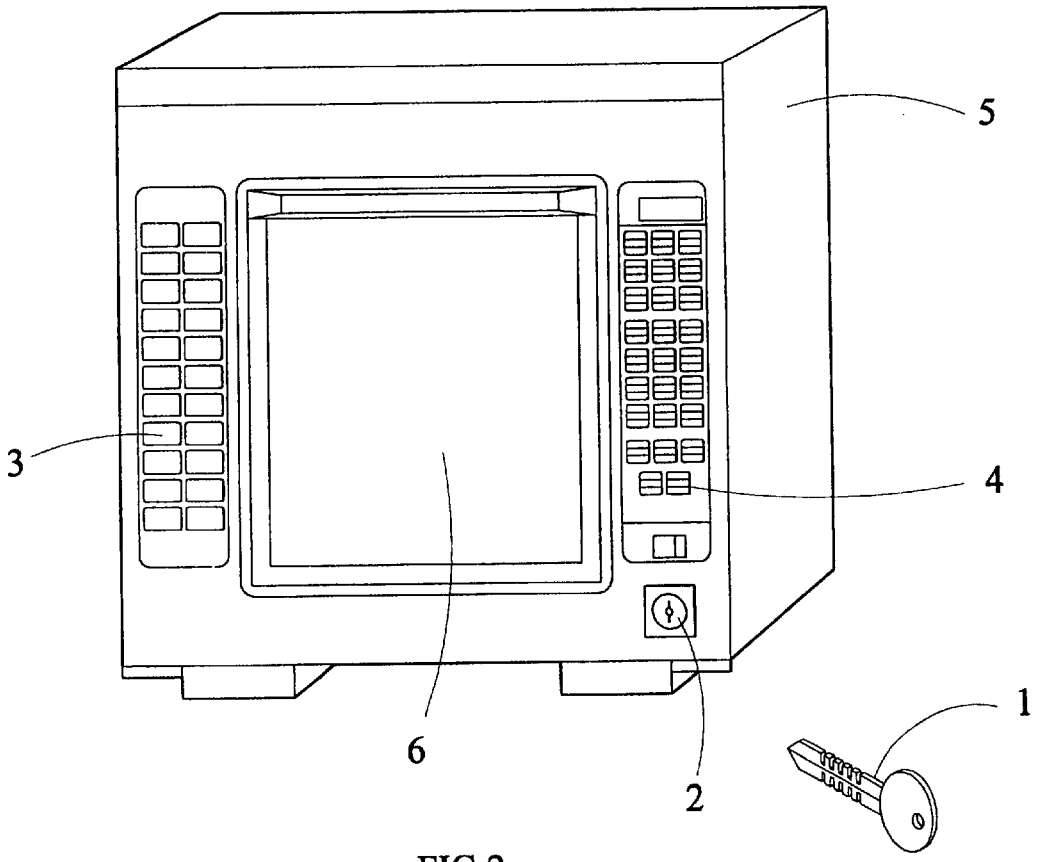
FIG. 2 shows a microwave combination oven provided with such a key aperture.

FIG. 2 shows the key reader 2 mounted in the front panel of a microwave combination oven 5 (for example model EV2451 made and sold by Merrychef Ltd). The oven 5 is provided with a manual control panel 4, door 6, and twenty pre-program keys 3 which allow twenty pre-programmed cooking sequences to be called up at the touch of a button.

Figure 3:
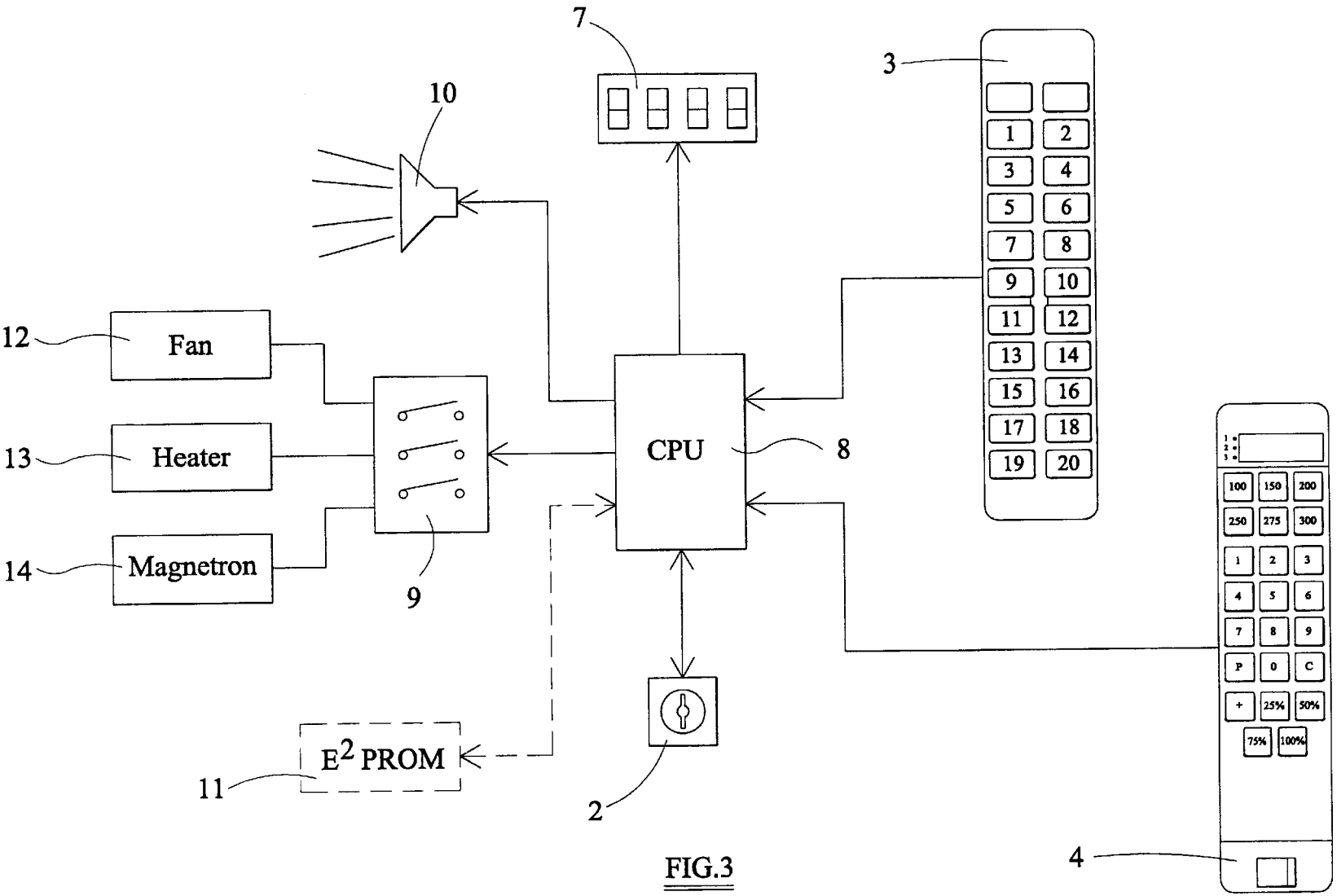
FIG. 3 is a schematic diagram showing the arrangement of components of the microwave combination oven.

FIG. 3 shows the electronic components of the oven 5, being the key reader 2, pre-program keys 3, manual control panel 4, together with a display 7, CPU (central processing unit) 8, switching unit 9, alarm/beeper 10, $E^2$PROM 11, fan 12, heater 13, and magnetron 14. The $E^2$PROM 11 exchanges data with the data key 1 via the CPU 8 in known manner.

The data key 1 is provided with program data corresponding to different cooking sequences at a data site, and is then sent to the cooking site for use with the oven 5, and with other programmable cooking devices (not shown), each of which is provided with a key reader 2. Although only the oven 5 is described here, the data key 1 operates with each other programmable cooking device in similar fashion.

FIG. 4 shows a typical arrangement of the memory of the data key 1. The memory is divided into 5 blocks, B1 to B5, each of which contains data corresponding to the cooking sequences of a different type of cooking device. Thus, in the example the blocks B1 to B5 correspond to a microwave combination oven, a microwave oven, a conventional convection oven, a steam combination oven, and a hob respectively.

In the example of FIG. 4, each block contains three programs, P1 to P3, each containing the data for a different cooking sequence comprising a number of stages S1, S2, S3 etc. Each stage contains data specifying the time, power and temperature (or other controllable features) for that stage of the cooking sequence.

The data key 1 can be inserted into any or all of the available cooking devices in order to update the program data for that cooking device. In the example of FIG. 4 the key 1 works with any cooking device of the type corresponding to a given block of the key memory. However, further embodiments are possible in which different blocks are provided for different cooking devices of the same type. For example, a given cooking site may have a number of microwave ovens of the same type which require different program data.

Figure 5:
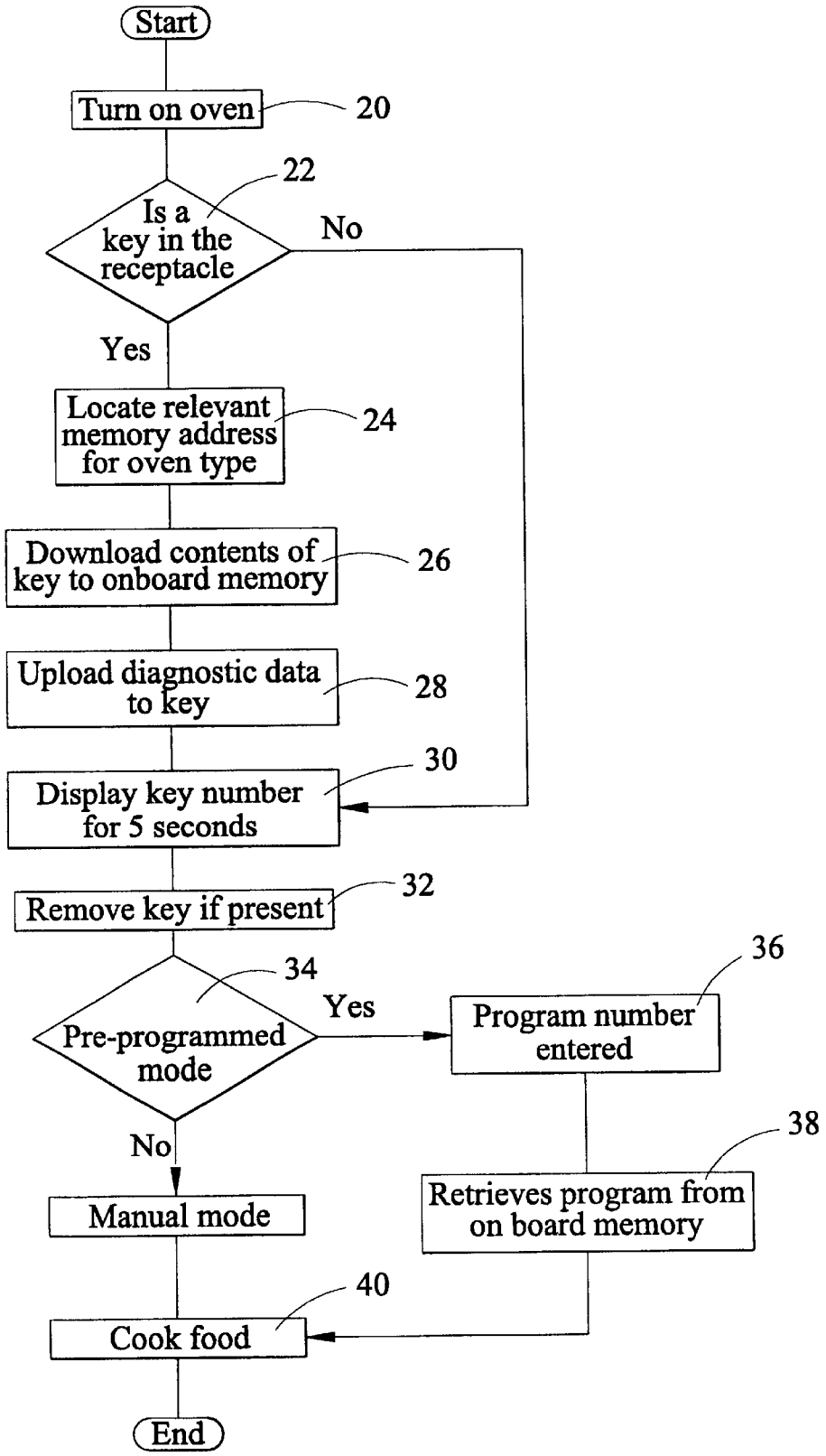
FIG. 5 shows the sequence of operations carried out in a first embodiment.

FIG. 5 shows the sequence of operations carried out by the oven 5.

In step 20 the oven 5 is turned on. In step 22 the oven 5 checks whether a key is present in the key reader 2. If a key is present, at step 24 the oven 5 locates the memory address for the relevant block B1 of memory on the data key 1 corresponding to cooking devices of the type of oven 5.

At step 26 the contents of block B1 are downloaded from the data key 1 to the $E^2$PROM 11 of oven 5.

At step 28 diagnostic and operational data is uploaded from the oven 5 to the data key 1. This data is then available for analysis when the data key 1 is returned to the data site at which the data key 1 was initially programmed, or to a separate analysis site. The operational data can be any data relating to the oven 5 and/or the way in which the oven 5 has been used. For example, the operational data may include the number of times each cooking sequence has been performed by the oven 5, the total time for which the oven 5 has been used, the times at which the oven 5 has been used, and so on.

Operational data can be uploaded to the data key 1 from each different programmable cooking device, and stored in different parts of the memory on the data key 1.

Each data key 1 can be assigned a different key number, and in step 30 the key number, which is read from the data key 1 by the key reader 2, is displayed on the display 7. For example, there may be different keys for different days of the week, or for different times of day, and the display of the key number therefore allows the chef to confirm that the correct key has been inserted. The keys can be physically connected together, for example on a single ring, and can also be colour coded using different colours to assist with the correct identification of each key.

If no key is present at step 22, the display 7 displays the key number of the last data key 1 to have been inserted into key reader 2. This confirms to the user which cooking sequences are currently stored by the oven 5.

In step 32 the data key 1 is removed from the key reader 2, and in step 34 the oven 5 determines whether the user has selected to operate the oven 5 in a manual, or pre-programmed mode. If the manual mode is selected, the oven 5 does not make use of the program data downloaded from the data key 1, and is simply operated using the manual control panel 4 in normal fashion.

If the user has selected the pre-program mode, then at step 36 the user enters the appropriate program number using pre-program keys 3, and at step 38 the oven 5 then retrieves the program data corresponding to the appropriate cooking sequence from the $E^2$PROM 11 and cooks the food at step 40.

Figure 6:
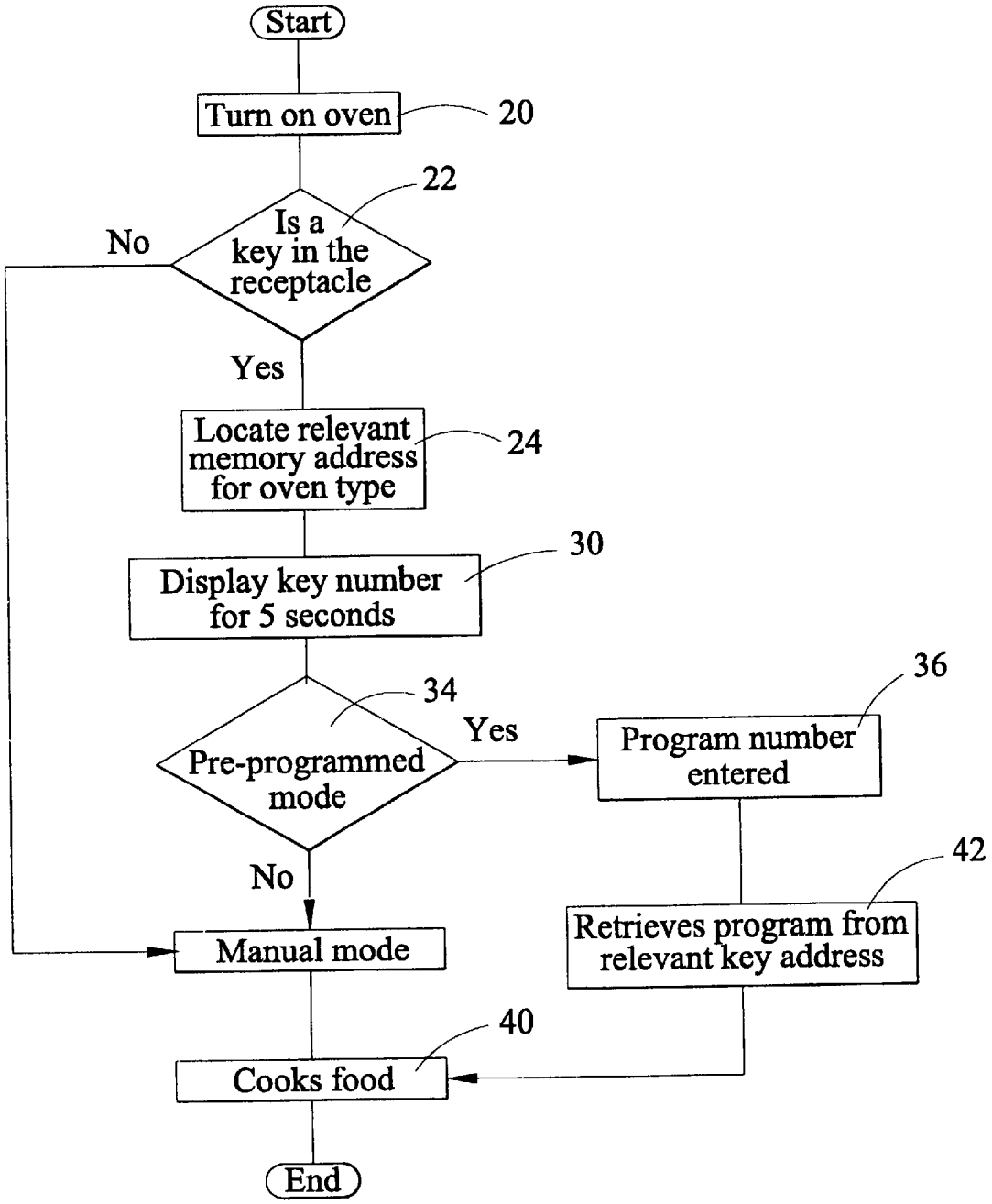
FIG. 6 shows the sequence of operations carried out in a second embodiment.

FIG. 6 shows the sequence of operations carried out by an alternative embodiment of oven 5. Steps corresponding to those in FIG. 5 are given the same reference numerals. However, in the embodiment of FIG. 6 the data key 1 is not removed from the oven 5 during operation, and at step 42 the program data is retrieved directly from the data key 1, rather than from the $E^2$ PROM 11 of the oven 5. In this embodiment use of the pre-programmed cooking sequences is only available while the data key 1 remains in the key reader 2.

In a further embodiment of the invention, the oven 5 is programmed so that it cannot be operated at all unless a data key is present in the key reader 2. This provides a useful security feature which has applications in various areas, including hospitals, schools and institutions where unauthorised use of the oven 5 could be hazardous.

Figure 7:
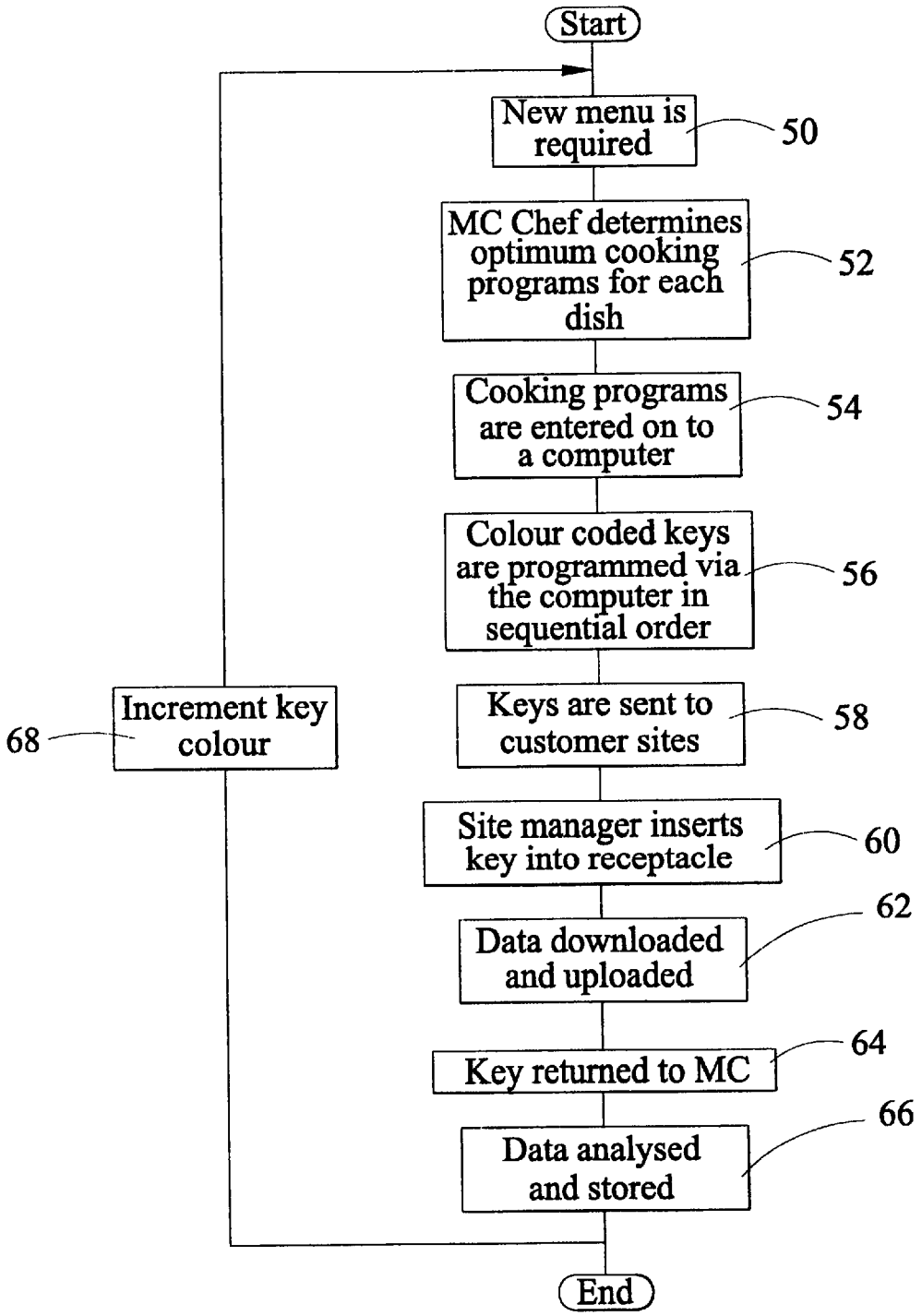
FIG. 7 shows the steps carried out in a method of operating a programmable cooking system in accordance with an embodiment of the invention.

FIG. 7 illustrates one embodiment of a method of operating a cooking system of the type described above. In FIG. 7 it is assumed that Merrychef Limited (denoted MC) acts as the data site and analysis site for a number of cooking sites.

At step 50 MC is advised that a new menu is required. MC then, at step 52 determines optimum cooking sequences or programmes for each item or dish on the menu. This requires experiments to be conducted with the various items on the menu in order to determine the optimum times, temperatures and powers for each stage in the cooking sequence for each dish. These experiments are conducted for a number of different programmable cooking devices, for example the cooking devices listed in FIG. 4.

At step 54 program data corresponding to the cooking sequences is entered on to a computer according to the format shown in FIG. 4.

At step 56 the program data is downloaded to a number of differently coloured data keys, the data on each key being arranged in the format of FIG. 4. It is assumed that the menu specifies that different dishes will be available on different days and at different times of day, and each key corresponds to a different time and has program data downloaded to it accordingly.

At step 58 the data keys are sent, for example, by post, from MC to each customer cooking site.

At step 60, the site manager or chef at each cooking site inserts the data keys into key readers of the programmable cooking devices at the appropriate times.

At step 62 data is downloaded from the data keys and uploaded to the data keys in the manner described above.

At step 64 each key is returned to MC, and at step 66 the uploaded data is analysed and stored by MC. The uploaded operational data can be used to determine how many meals of each type have been cooked, and this data can be used for stock control and stock ordering purposes. The uploaded operational data can also indicate how long each cooking device has been used for. If the cooking devices are supplied by MC under warranty, such data can be used to determine whether or not the cooking devices fall within the terms of the warranty. For example, a warranty may specify that a cooking device only remains under warranty if its usage, or usage within a given period of time, falls below a certain number of hours. The operational data can also be used in a variety of other ways. For example, it sometimes happens that the cooking device which is located nearest to a given chef or cook is over-used relative to another cooking device of the same type at the cooking site. The operational data can be used to determine and correct such patterns of use.

Step 68 indicates that different coloured data keys are used for the next menu for which MC prepares data keys.

What is claimed is:

1. A programmable cooking system comprising a plurality of separate programmable cooking devices and at least one data key, wherein each data key is provided with a data memory for storing program data corresponding to sequences of cooking operations, and said data memory is divided into a plurality of parts each corresponding to a respective one of said cooking devices, and wherein each programmable cooking device comprises:

a programmable control means for controlling the cooking device to carry out sequences of cooking operations;

a key aperture adapted to receive one of said data keys; and a data reader arranged to read from the data key program data from that part of the data memory corresponding to the cooking device, and to pass said program data to the programmable control means of the cooking device, thus making the appropriate sequences of cooking operations available to the cooking device.

2. A programmable cooking system as claimed in claim 1, wherein at least one of said programmable cooking devices is a programmable oven.

3. A programmable cooking system as claimed in claim 2, wherein at least one of said programmable cooking devices is a microwave oven or microwave combination oven.

4. A programmable cooking system as claimed in claim 1, wherein each of said parts of said data memory corresponds to a different type of programmable cooking device, and is adapted to transfer said program data to any cooking device of that type.

5. A programmable cooking system as claimed in claim 1, wherein each programmable cooking device further comprises a data writer, arranged to write operational data to the data memory of the data keys when located in the key apertures.

6. A programmable cooking system as claimed in claim 5, wherein said operational data includes data representing the length of time for which the cooking device has been used.

7. A programmable cooking system as claimed in claim 5, wherein said operational data includes data representing which sequences of cooking operations have been carried out by the cooking devices, and in what numbers.

8. A programmable cooking system as claimed in claim 1, wherein each cooking device can be activated only when one of said data keys is located in its key aperture.

9. A programmable cooking system as claimed in claim 1, which comprises a plurality of such data keys each carrying different program data, thus allowing a user to choose which cooking sequences to make available to the cooking devices, and to make different cooking sequences available at different times.

10. A programmable cooking system as claimed in claim 9, wherein the data keys are physically connected to each other.

11. A programmable cooking system as claimed in claim 9, wherein different data keys carry program data corresponding to menus of food intended to be served at different times.

12. A programmable cooking system as claimed in claim 9, wherein different data keys are different colours, in order to provide more simple identification to a user.

13. A method of operating a programmable cooking system as claimed in claim 1, the method comprising:

a) downloading said program data to the data memory means of the each data key;

b) inserting at least one of the data keys into the key aperture of selected one of said cooking devices;

c) allowing a user to cook food using the selected cooking device by a selecting a suitable sequence of cooking operations represented by said program data for said selected cooking device;

d) allowing the user to repeat this for other food products if desired.

14. A method as claimed in claim 13 wherein the cooking devices are located at a cooking site, and the step of downloading said program data is carried out at a data site which is remote from said cooking site.

15. A method as claimed in claim 13 wherein each programmable cooking device includes a data writer, arranged to write operational data to the data memory of the data keys when located in the key aperture, and wherein the method further includes the step of the data writer of the selected cooking device writing to the data memory of at least one data key operational data relating to the operation of the selected cooking device.

16. A method as claimed in claim 15, wherein said operational data includes the numbers of each type of food product to have been cooked by the cooking device.

17. A method as claimed in claim 16, wherein said operational data representing the numbers of each type of food product cooked is analysed in order to provide stock-control information, and orders for further food products are made on the basis of said stock-control information.

18. A method as claimed in claim 15, wherein said operational data includes data representing the total time for which the oven has been used since a given point in time.

19. A method as claimed in claim 18, wherein said operational data representing the total time for which the selected cooking device has been used is analysed in order to provide usage information, and said usage information is used to determine whether the selected cooking device falls within the terms of a warranty on the selected cooking device provided by a supplier to the selected cooking device user.

20. A method as claimed in claim 15, wherein said operational data includes data representing the manner in which the selected cooking device has been used.

21. A method as claimed in claim 20, wherein said operational data representing the manner in which the selected cooking device has been used is used to make management decisions affecting the future use of the selected cooking device, including for example a decision that the selected cooking device has been over-used in comparison to another cooking device.

22. A method as claimed in claim 15, wherein after use each data key is sent to an analysis site, remote from the cooking site, at which the operational data in said data memory is analysed.

23. A method as claimed in claim 22, wherein the cooking devices are located at a cooking site, and the step of downloading said program data is carried out at a data site which is remote from said cooking site, and wherein said data and analysis sites are one and the same site.

* * * * *